US007874762B2

(12) United States Patent
Shaw et al.

(10) Patent No.: US 7,874,762 B2
(45) Date of Patent: Jan. 25, 2011

(54) DOWEL DEVICE WITH CLOSED END SPEED COVER

(75) Inventors: Lee A. Shaw, Newport Beach, CA (US); Ronald D. Shaw, Corona Del Mar, CA (US)

(73) Assignee: Shaw & Sons, Inc., Costa Mesa, CA (US)

( * ) Notice: Subject to any disclaimer, the term of this patent is extended or adjusted under 35 U.S.C. 154(b) by 0 days.

(21) Appl. No.: 12/561,491

(22) Filed: Sep. 17, 2009

(65) Prior Publication Data

US 2010/0003080 A1 Jan. 7, 2010

Related U.S. Application Data

(60) Continuation of application No. 11/951,995, filed on Dec. 6, 2007, now abandoned, which is a division of application No. 11/300,138, filed on Dec. 14, 2005, now abandoned.

(51) Int. Cl.
*E01C 11/14* (2006.01)
*E01C 11/02* (2006.01)

(52) U.S. Cl. ..... 404/61; 404/60; 52/396.02; 52/699; 52/700

(58) Field of Classification Search ..... 52/396.02, 52/699–701

See application file for complete search history.

(56) References Cited

U.S. PATENT DOCUMENTS 754,215 A 3/1904 Hayward
1,045,562 A 11/1912 Kennedy
1,545,267 A 7/1925 Marye
1,592,681 A 7/1926 Grothe (Continued)

FOREIGN PATENT DOCUMENTS

CH 568457 10/1975

(Continued)

OTHER PUBLICATIONS www.danley.com.au; "Danley Diamond Dowel System"; Mar. 24, 2005; 2 pages.

(Continued)

*Primary Examiner*—Raymond W Addie
(74) *Attorney, Agent, or Firm*—Stetina Brunda Garred & Brucker

(57) ABSTRACT

Disclosed are a concrete dowel placement devices and a method of utilizing the same. A metallic stud is driven, screwed, or otherwise attached to a form. The stud may be a unitary structure, or may be a hollow tube with conventional fastening means such as nails and screws extending through and holding the hollow tube to the form. A cover having an interior compartment substantially equal in diameter to the stud is slid ably placed thereon, and a first enclosed area is developed with a plurality of forms. Concrete is poured into the first enclosed area, and upon curing, the form and the stud are removed, leaving the cover embedded in the concrete. A metallic dowel is inserted into the cover, and a second enclosed area is developed with like configured forms. The metallic dowel extends into the second enclosed area. Upon pouring concrete into the second enclosed area, a cold joint is formed between the concrete of the first enclosed area and the concrete of the second enclosed area, supported and braced by the metallic dowel.

32 Claims, 4 Drawing Sheets

U.S. PATENT DOCUMENTS

| | | | | |
|---|---|---|---|---|
| 1,728,936 | A | 9/1929 | Johnson | |
| 1,755,219 | A | 4/1930 | Knox | |
| 1,826,062 | A | 10/1931 | Farmer | |
| 1,838,635 | A | 12/1931 | Pilj | |
| 1,852,673 | A | 4/1932 | Pilj | |
| 1,939,007 | A | 12/1933 | Heltzel | |
| 1,942,494 | A | 1/1934 | Robertson | |
| 1,953,846 | A | 4/1934 | Briggs | |
| 2,095,060 | A | 10/1937 | Geyer | |
| 2,096,702 | A | 10/1937 | Yeoman | |
| 2,108,107 | A * | 2/1938 | De Wees | 52/701 |
| 2,129,568 | A | 9/1938 | De Biasi | |
| 2,166,220 | A | 7/1939 | Older | |
| 2,181,005 | A | 11/1939 | Westcott | |
| 2,262,704 | A | 11/1941 | Tompkins et al. | |
| 2,269,703 | A | 1/1942 | Bagwill | |
| 2,275,272 | A | 3/1942 | Scripture, Jr. | |
| 2,277,203 | A | 3/1942 | Boult | |
| 2,296,453 | A | 9/1942 | Saffert | |
| 2,319,526 | A | 5/1943 | Weam | |
| 2,331,949 | A | 10/1943 | Whiteman | |
| 2,365,550 | A | 12/1944 | Heltzel | |
| 2,373,284 | A | 4/1945 | Autrey | |
| 2,508,443 | A | 5/1950 | Carter | |
| 2,636,426 | A | 4/1953 | Heltzel | |
| 2,746,365 | A | 5/1956 | Dameille | |
| 2,823,539 | A | 2/1958 | Kersh et al. | |
| 2,980,215 | A | 4/1961 | Englund | |
| 3,066,448 | A | 12/1962 | Pinter | |
| 3,279,335 | A | 10/1966 | Garner | |
| 3,284,973 | A | 11/1966 | Ames et al. | |
| 3,318,224 | A | 5/1967 | Bohanon | |
| 3,333,380 | A | 8/1967 | Wolf | |
| 3,437,017 | A | 4/1969 | Walz et al. | |
| 3,451,179 | A | 6/1969 | Kendzia | |
| 3,527,486 | A | 9/1970 | Gamp | |
| D229,538 | S | 12/1973 | Steffan | |
| 3,896,599 | A | 7/1975 | Werstein et al. | |
| 3,920,221 | A | 11/1975 | Berry et al. | |
| 3,921,356 | A | 11/1975 | Hughes | |
| 4,077,177 | A | 3/1978 | Boothroyd et al. | |
| 4,087,072 | A | 5/1978 | Olsen | |
| 4,115,976 | A | 9/1978 | Rohrer | |
| 4,146,599 | A | 3/1979 | Lanzetta | |
| 4,158,937 | A | 6/1979 | Henry | |
| D257,503 | S | 11/1980 | McKee | |
| 4,252,767 | A | 2/1981 | Piazza et al. | |
| 4,261,496 | A | 4/1981 | Mareydt et al. | |
| 4,329,080 | A | 5/1982 | Elley | |
| D272,517 | S | 2/1984 | Koehn | |
| 4,437,828 | A | 3/1984 | Egger | |
| 4,449,844 | A | 5/1984 | Larsen | |
| 4,493,584 | A | 1/1985 | Guntert | |
| 4,496,504 | A | 1/1985 | Steenson et al. | |
| 4,533,112 | A | 8/1985 | Santos, Jr. et al. | |
| 4,578,916 | A | 4/1986 | Witschi | |
| 4,614,070 | A | 9/1986 | Idland | |
| 4,648,739 | A | 3/1987 | Thomsen | |
| 4,657,430 | A | 4/1987 | Marionneaux | |
| 4,726,561 | A * | 2/1988 | Worzala, Jr. | 249/61 |
| 4,748,788 | A | 6/1988 | Shaw et al. | |
| 4,752,153 | A | 6/1988 | Miller | |
| 4,800,702 | A | 1/1989 | Wheeler | |
| 4,801,425 | A | 1/1989 | Michel et al. | |
| 4,821,988 | A | 4/1989 | Jimenez | |
| 4,883,385 | A | 11/1989 | Kaler | |
| 4,899,497 | A | 2/1990 | Madl, Jr. | |
| 4,926,593 | A | 5/1990 | Johnston | |
| 4,938,631 | A | 7/1990 | Maechtle et al. | |
| 4,959,940 | A | 10/1990 | Witschi | |
| D314,325 | S | 2/1991 | Ziaylek, Jr. et al. | |
| 4,996,816 | A | 3/1991 | Wiebe | |
| 5,005,331 | A | 4/1991 | Shaw et al. | |
| 5,046,898 | A | 9/1991 | McKinney | |
| 5,096,155 | A | 3/1992 | Fitzgerald | |
| 5,134,828 | A | 8/1992 | Baur | |
| 5,205,942 | A | 4/1993 | Fitzgerald | |
| 5,212,919 | A | 5/1993 | Shaw et al. | |
| 5,216,862 | A | 6/1993 | Shaw et al. | |
| 5,301,485 | A | 4/1994 | Shaw et al. | |
| D363,211 | S | 10/1995 | Noble | |
| 5,487,249 | A | 1/1996 | Shaw et al. | |
| D375,599 | S | 11/1996 | Hirano et al. | |
| D375,600 | S | 11/1996 | Hirano et al. | |
| 5,618,125 | A | 4/1997 | McPhee et al. | |
| 5,678,952 | A | 10/1997 | Shaw et al. | |
| 5,694,730 | A | 12/1997 | Del Rincon et al. | |
| 5,713,174 | A | 2/1998 | Kramer | |
| 5,797,231 | A | 8/1998 | Kramer | |
| 5,934,821 | A | 8/1999 | Shaw et al. | |
| D419,700 | S | 1/2000 | Shaw et al. | |
| 6,018,833 | A | 2/2000 | Imm | |
| 6,123,485 | A | 9/2000 | Mirmiran et al. | |
| 6,145,262 | A | 11/2000 | Schrader et al. | |
| 6,210,070 | B1 | 4/2001 | Shaw et al. | |
| 6,243,994 | B1 | 6/2001 | Bernini | |
| 6,354,053 | B1 | 3/2002 | Kerrels | |
| 6,354,760 | B1 | 3/2002 | Boxall et al. | |
| D459,205 | S | 6/2002 | Shaw et al. | |
| 6,502,359 | B1 | 1/2003 | Rambo | |
| 6,517,277 | B2 | 2/2003 | Hu et al. | |
| 6,655,869 | B1 | 12/2003 | Deeb et al. | |
| 6,926,463 | B2 | 8/2005 | Shaw et al. | |
| 7,004,443 | B2 | 2/2006 | Bennett | |
| 7,314,333 | B2 | 1/2008 | Shaw et al. | |
| 7,338,230 | B2 | 3/2008 | Shaw et al. | |
| 7,381,008 | B2 | 6/2008 | Shaw et al. | |
| 7,604,432 | B2 | 10/2009 | Shaw et al. | |
| 2005/0265802 | A1 | 12/2005 | Miller et al. | |

FOREIGN PATENT DOCUMENTS

| | | |
|---|---|---|
| DK | 79813 | 9/1955 |
| EP | 1123443 | 8/2001 |
| EP | 1389648 | 2/2004 |
| FR | 1094449 | 5/1995 |
| WO | WO 0023653 | 4/2000 |

OTHER PUBLICATIONS www.pavement.com; "Load Transfer"; May 27, 2003; 2 pages.
www.pna-inc.com; "The Diamond Dowel System"; May 22, 2003; 2 pages.
Wayne W. Walker and Jerry A. Holland; "Plate Dowels for Slabs on Ground"; 4 pages.
John P. Broomfield; "Corrosion of Steel in Concrete"; 1997; 3 pages.

* cited by examiner

DOWEL DEVICE WITH CLOSED END SPEED COVER

CROSS-REFERENCE TO RELATED APPLICATIONS

The present application is a continuation application of U.S. patent application Ser. No. 11/951,995 entitled DOWEL DEVICE WITH CLOSED END SPEED COVER filed Dec. 6, 2007, now abandoned which is a divisional application of U.S. patent application Ser. No. 11/300,138 entitled DOWEL DEVICE WITH CLOSED END SPEED COVER filed Dec. 14, 2005, now abandoned the entirety of the disclosures of which are expressly incorporated herein by reference.

STATEMENT RE: FEDERALLY SPONSORED RESEARCH/DEVELOPMENT

Not Applicable

BACKGROUND

1. Technical Field

The present invention relates generally to the art of concrete construction. More particularly, the present invention relates to an apparatus for facilitating the placement of slip dowel rods within adjacent concrete slabs.

2. Related Art

In the concrete construction arts, "cold joints" between two or more poured concrete slabs are frequently used for the paving of sidewalks, driveways, roads, and flooring in buildings. Such cold joints frequently become uneven or buckled due to normal thermal expansion and contraction of the concrete and/or compaction of the aggregate caused by inadequate preparation prior to pouring of concrete. As a means of preventing bucking or angular displacement of such cold joints, it is common practice to insert smooth steel dowel rods generally known as "slip dowels" within the edge portions of adjoining concrete slabs in such a matter that the concrete slabs may slide freely along one or more of the slip dowels, permitting linear expansion and contraction of the slabs while also maintaining the slabs in a common plane and thus preventing undesirable bucking or unevenness of the cold joint.

In order to function effectively, slip dowels must be accurately positioned parallel within the adjoining concrete slabs. The non-parallel positioning of the dowels will prevent the desired slippage of the dowels and will defeat the purpose of the "slip dowel" application. Additionally, the individual dowels must be placed within one or both of the slabs in such a manner as to permit continual slippage or movement of the dowels within the cured concrete slab(s).

A number of methods of installing smooth slip dowels are popular. According to one method, a first concrete pour is made within a pre-existing form. After the first pour has cured, and edge of the form, usually a wooden stud, is stripped away. A series of holes are then drilled parallel into the first pour along the exposed edge from which the form has been removed. The depth and diameter of the individual holes varies depending on the application and the relative size of the concrete slabs to be supported. As a general rule, however, such holes are at least twelve inches deep and typically have a diameter of approximately five-eighths (⅝) of an inch.

After the parallel series of holes have been drilled into the first pour, smooth dowel rods are advanced into each hole such that one end of each dowel rod is positioned within the first pour and the remainder of each dowel rod is positioned within the first pour and the remainder of each dowel rod extends into an adjacent area where a second slab of concrete is to be poured. Thereafter, concrete is poured into such adjacent area and is permitted to set with the parallel aligned dowels extending thereto. After the second pour has cured, the slip dowels will be held firmly within the second slab, but will be permitted to slide longitudinally within the drilled holes of the first slab thereby accommodating longitudinal expansion and contraction of the two slabs while at the same time preventing buckling or angular movement therebetween.

Although the above-described "drilling method" of placing slip dowels is popular, it will be appreciated that such method is extremely labor intensive. In fact, it takes approximately ten minutes to drill a five eighths inch (⅝") diameter by twelve inch long hole into the first pour and the drilling equipment, bits, accessories, and associated set up time tends to be very expensive. Moreover, the laborers who drill the holes and place the slip dowels must be adequately trained to ensure that the dowels are arranged perpendicular to the joint but parallel to one another so as to permit the desired slippage.

Another popular method of placing slip dowels involves the use of wax-treated cardboard sleeves positioned over one end of each individual dowel. According to such method, a series of holes are drilled through one edge of the concrete form and smooth dowels are advanced through each such hole. Thereafter, the treated cardboard sleeves are placed over one end of each dowel, with a first pour subsequently being made within the form which covers the ends of the dowels including the cardboard sleeves thereon. After the first pour has set, the previously drilled form is stripped away, leaving the individual dowels extending into a neighboring open space where the second pour is to be made. Subsequently, the second pour is made and cured. Thereafter, the slip dowels will be firmly held by the concrete of the second pour, but will be permitted to longitudinally slide against the inner surfaces of the wax treated cardboard sleeves within the first pour. Thus, the waxed cardboard sleeves facilitate longitudinal slippage of the dowels, while at the same time holding the two concrete slabs in a common plane, and preventing undesirable buckling or angular movement thereof.

This method was also associated with numerous deficiencies, namely, that after the first pour was made, the free ends of the dowels were likely to project as much as eighteen inches through the form and into the open space allowed for the second pour. Because the drilled section of the form must be advanced over those exposed sections of dowel to accomplish stripping or removal of the form, it is not infrequent for the exposed portions of the dowels to become bent and, thus, non-parallel. Additionally, the drilled section of the form became damaged or broken during the removal process, thereby precluding its reuse.

Each of the above described known methods of placing slip dowels between concrete slabs often results in the dowels being finally positioned at various angles rather than in the desired parallel array. Therefore, the necessary slippage of the dowels is impeded or prevented.

In response to such deficiencies in the art, a number of dowel placement sleeves have been developed. One such development is U.S. Pat. No. 5,005,331 to Shaw, et al., which is wholly incorporated by reference herein, teaches a slip dowel positioning device that is extractable from the first concrete slab. The device is comprised of a hollow cylindrical portion with a flange or gusset extending perpendicularly therefrom. The flange permitted the device to be attached to the form, and upon curing, the form was removed, thereby also removing the positioning device. Thereafter, a smooth dowel was inserted in the cavity formed in the space previously occupied by the positioning device, and a subsequent slab of concrete was poured. One of the deficiencies associated with the '331 device was that it was required to be removed from a cured slab of concrete, necessitating extra force during removal. Further, the configuration which enabled the positioning device to be removable resulted in a cavity which was less than ideal, in that slight discrepancies in the angular displacement of the smooth dowel are introduced. Therefore, slip dowel placement which was truly parallel to the concrete surface is not possible.

Thus, alternatively, the '331 patent and additionally U.S. Pat. No. 5,216,862 to Shaw, et al., which is also incorporated by reference wherein, contemplated a positioning device which remained in the concrete slab. The positioning device was attached to the form via staples or small nail heads, and forcibly stripped upon curing of the first slab of concrete. However, the requirement of forcibly removing the form from the positioning device remained.

Accordingly there is a need in the art for an inexpensive and readily reproducible dowel positioning device which can remain in the concrete slab after curing. Further, there is a need for a dowel positioning device which can be attached and removed from a form with minimal force and a minimum number of extraneous components. These needs and more are accomplished with the present novel and inventive device, the details of which are discussed more fully hereunder.

BRIEF SUMMARY

In light of the foregoing problems and limitations, the present invention was conceived. In accordance with one embodiment of the present invention, provided is a concrete dowel placement device for attachment to a form. More particularly, the device comprises a stud having a generally tubular body, a proximal stud end and a distal stud end, and a cover having a generally tubular body having an outer cover surface, an open proximal cover end, a closed distal cover end, and a hollow cover interior compartment extending axially therein configured to slidably receive the stud. In one embodiment, the stud is of uniform construction and has a form insertion section disposed towards the proximal stud end and encompassed by the form, and a cover insertion section disposed towards the distal stud end and encompassed by the cover. The form insertion section extends beyond the proximal cover end when the cover is placed on the stud. Furthermore, the form insertion section is tapered to a point defining the proximal stud end for ease in driving the stud into the form. Alternatively, the form insertion section is threaded and tapered to a point defined by the proximal stud end for screwing the stud into the form. In order to enable the stud to be screwed into the form, the distal stud end defines a molded surface configured to cooperate with a screwdriver head.

In accordance with another embodiment of the present invention, the distal stud end and the proximal stud end each have an opening and a hollow stud interior compartment extending axially therebetween. The stud is configured to slidably receive a nail having a length greater than that of the hollow stud interior compartment, the nail having a head in an abutting relationship with the distal stud end and a point driven into the form. In another embodiment, the stud is configured to receive a threaded screw having a length greater than that of the hollow stud interior compartment, with the screw having a head in an abutting relationship with the distal stud end and a point screwed into the form. Further, the stud may include threading disposed in the hollow stud interior compartment to cooperatively retain the threaded screw.

According to yet another aspect of the present invention, the cover includes an integrated flange on the proximal cover end. Preferably, the cover is formed of plastic, and the stud is ¼ inch in diameter. Along these lines, the hollow stud interior compartment is also ¼ in diameter.

In accordance with still another aspect of the present invention, disclosed is a method for forming a cold joint between adjoining sequentially formed slabs of concrete. The method is comprised of a) securing one or more studs to one or more forms; b) attaching a cover on to a respective one of the studs; c) forming a first enclosed area with the forms; d) pouring a first stab of concrete into the first enclosed area; e) curing the first slab of concrete; f) slidably removing the forms from the slab of concrete thereby concurrently withdrawing the studs from the covers, wherein the covers remains within the first slab of concrete; g) inserting a dowel into each of the covers remaining in the first slab of concrete; h) attaching a cover on to respective ones of the studs on the form; i) forming a second enclosed area adjacent to the first slab of concrete with the forms, wherein at least a part of the second enclosed area is defined by an edge of the first concrete slab and at least one of the dowels extend into the second enclosed area; j) pouring a second slab of concrete into the second enclosed area; and k) curing the second slab of concrete. The dowel is generally cylindrical, and may be constructed of stainless steel, while the covers are constructed of plastic.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below in connection with the appended drawings is intended as a description of the presently preferred embodiment of the invention, and is not intended to represent the only form in which the present invention may be constructed or utilized. The description sets forth the functions and the sequence of steps for developing and operating the invention in connection with the illustrated embodiment. It is to be understood, however, that the same or equivalent functions and sequences may be accomplished by different embodiments that are also intended to be encompassed within the spirit and scope of the invention. It is further understood that the use of relational terms such as first and second, and the like are used solely to distinguish one from another entity without necessarily requiring or implying any actual such relationship or order between such entities.

Figure 1A:
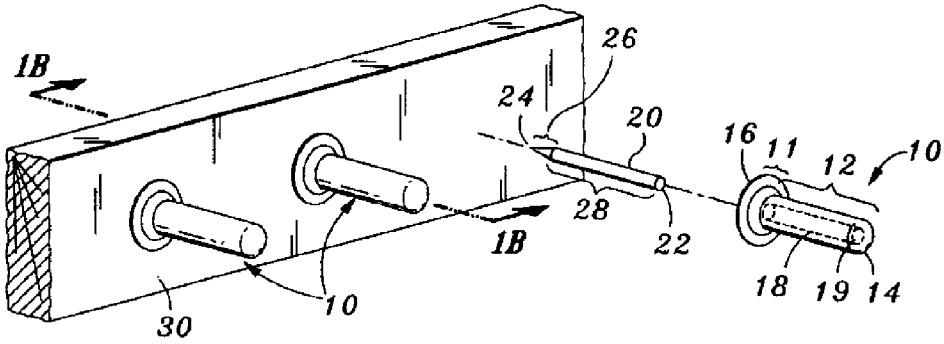
FIG. 1*a* is a perspective view of a first embodiment of a stud and a speed cover in accordance with an aspect of the present invention.
Figure 1B:
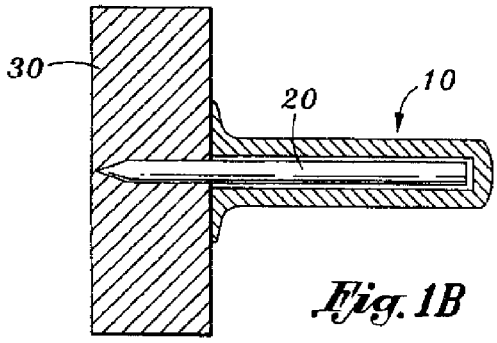
FIG. 1*b* is a side view of a first embodiment of a speed cover attached to a stud which is inserted into a form.
Figure 2A:
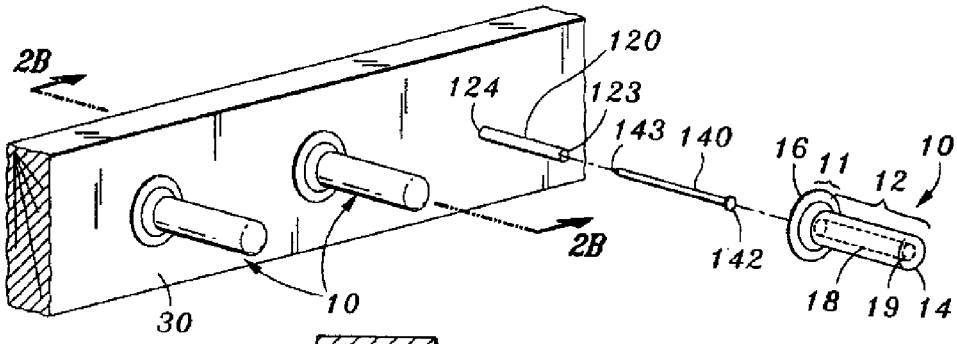
FIG. 2*a* is an exploded perspective view of a second embodiment of a stud having an open distal and proximal ends with a nail to be inserted therethrough and a speed cover.
Figure 3A:
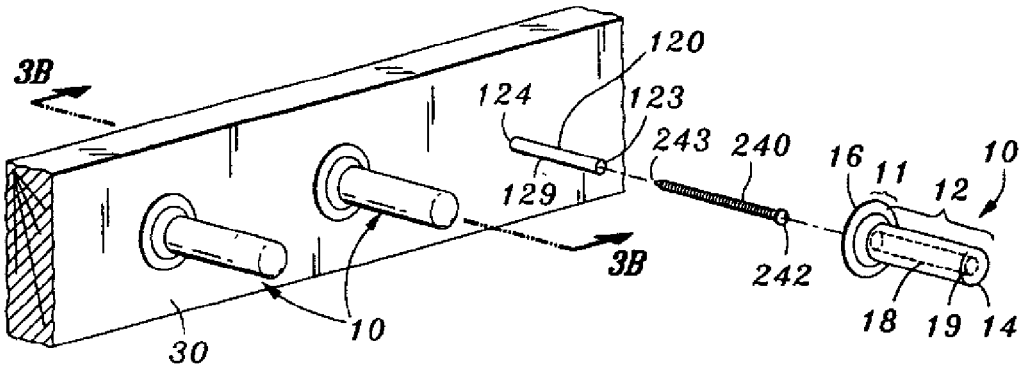
FIG. 3*a* is an exploded perspective view of a third embodiment of a stud having an open distal and proximal ends with a screw to be inserted therethrough and a speed cover.

With reference now to the figures, specifically FIG. 1*a* and FIG. 1*b*, a first embodiment of the present inventive dowel device with a closed end speed cover is shown. A form 30, which by way of example only and not of limitation, is constructed of wood or any other material well known in the art capable of rigidly defining an enclosed area, and capable of receiving and retaining a fastener such as a stud 20, a nail 140 as illustrated in FIG. 2*a* or a screw 240 as illustrated in FIG. 3*a*. Still referring to FIG. 1*a* and FIG. 1*b*, according to a first embodiment of the present invention, the stud 20 includes a tapered section 26, which tapers to define a sharp point disposed at a proximal end 24, a shaft portion 28, and a distal end 22. The proximal end 24 is inserted or driven into the form 30, and is frictionally retained therein. As will be appreciated by one having ordinary skill in the art, the tapered section 26 enables the stud 20 to be driven into the form 30 with a lesser amount of force. The stud 20 is typically a quarter-inch (¼") in diameter, and may be constructed of any suitable material such as steel, stainless steel, or other metals having sufficient strength to prevent deformation of the stud 20 upon driving the same into the form 30.

After driving the stud 20 into the form 30, a speed cover 10 is placed on the stud 20, covering the exposed part of a shaft portion 28, i.e., the portion not encompassed by the form 30. The speed cover 10 is defined by a tubular body 12, a closed distal end 14, and an open proximal end 16, and includes an interior compartment 18 which extends axially from an interior distal end surface 19 through a tubular body 12 to the open proximal end 16. The diameter of the interior compartment 18 is sufficient to enable a sliding relationship between the speed cover 10 and stud 20. While the preferred configuration is for the distal end 22 of the stud 20 to be in an abutting relationship with the interior distal end surface 19, and the open proximal end 16 to be in an abutting relationship with the form 30, strict adherence to this configuration is not necessary. For example, the stud 20 may be inserted further into the form 30, leaving a slight gap between the distal end 22 of the stud 20 and the interior distal end surface 19 of the speed cover 10 when it is positioned on the stud 20. Preferably, though not necessarily, the proximal end 16 additionally defines a flange 11 extending arcuately about the speed cover 10. Further, the speed cover 10 may be integrally formed of a plastic material fabricated by conventional molding techniques.

Figure 2B:
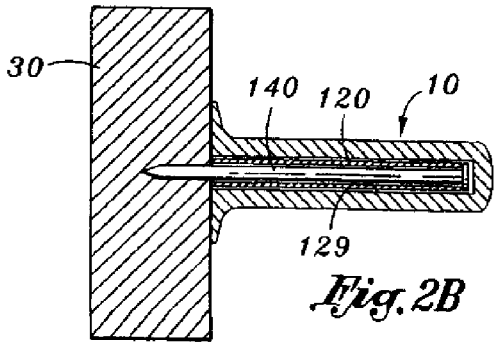
FIG. 2*b* is a side view of a second embodiment of a speed cover attached to a stud secured by a conventional nail which is inserted into a form.

In a second embodiment shown in FIGS. 2*a* and 2*b*, a sleeve stud 120 has an open distal end 123, with an interior compartment 129 extending therethrough. An open proximal end 124 is in an abutting relationship with the form 30, and a conventional nail 140 having a nail point 143 and a nail head 142 is inserted through the interior compartment 129 and driven through the form 30. The diameter of the interior compartment 129 is larger than that of the nail 140, thereby enabling a sliding relation between the sleeve stud 120 and the nail 140, while smaller than that of the nail head 140 to prevent the sleeve stud 120 from being withdrawn from the nail 140 once inserted. The diameter of the sleeve stud 120 is typically quarter-inch (¼") and may be constructed of metal or other suitable material. Like the aforementioned first embodiment, the speed cover 10 includes a tubular body 12, an interior compartment 18, a closed distal end 14, and an open proximal end 16, through which the sleeve stud 120 may be inserted. The proximal end 16 is preferably in an abutting relation to the form 30 once placed on to the stud 120. Additionally, the proximal end 16 may also define the flange 11.

Figure 3B:
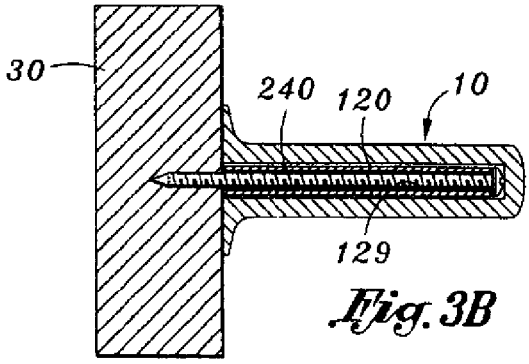
FIG. 3*b* is a side view of a third embodiment of a speed cover attached to a stud secured by a conventional screw which is inserted into a form.

Referring now to FIGS. 3*a* and 3*b*, a third embodiment of the present invention is shown, with the sleeve stud 120 having the open proximal end 124, the open distal end 123, and the interior compartment 129 extending therebetween. Instead of a nail as in the second embodiment, a screw 240 having a screw point 243 and a screw head 242 is provided. The screw 240 is inserted through the sleeve stud 120, and screwed or threaded through the form 30. The screw head 242 preferably includes molding that cooperates with a screwdriver head. Such screw heads include standard Phillips heads, flatheads, hexagonal heads, or any other like configuration well known in the art. Optionally, the screw 240 may be integrally formed with the sleeve stud 120 to eliminate the manual step of inserting the screw 240 through the sleeve stud 120. As in the previously mentioned first and second embodiments, the speed cover 10 has the open proximal end 16, the closed distal end 14, and the interior compartment 18 which is in a sliding relationship with the sleeve stud 120. Further, the speed cover 10 may be integrally formed of a molded plastic, and may include the flange 11 extending from the speed cover 10 in an arcuate fashion. In general, it is to be understood that any fastening mechanism having an elongate structure with a head or other like feature which directly or indirectly cooperates with the stud 120 to attach the same to form 30 is understood to be encompassed by the present invention.

While reference has been made to the "stud" 20 as in FIGS. 1*a* and 1*b*, and to the "sleeve stud" 120 as in FIGS. 2*a*, 2*b*, 3*a*, and 3*b*, it will be understood that with regard to the relationship to the speed cover 10, both "stud" 20 and "sleeve stud" 120 include an elongate entity which interfaces with the interior compartment 18. As used henceforth in describing the formation of a concrete structure, the two terms may be readily interchanged. Further, it is also to be understood that the diameter of studs 20 and sleeve stud 120 are substantially the same as that of a dowel to be used to rigidify the cold joint between a first pour and a second pour of concrete.

Figure 4:
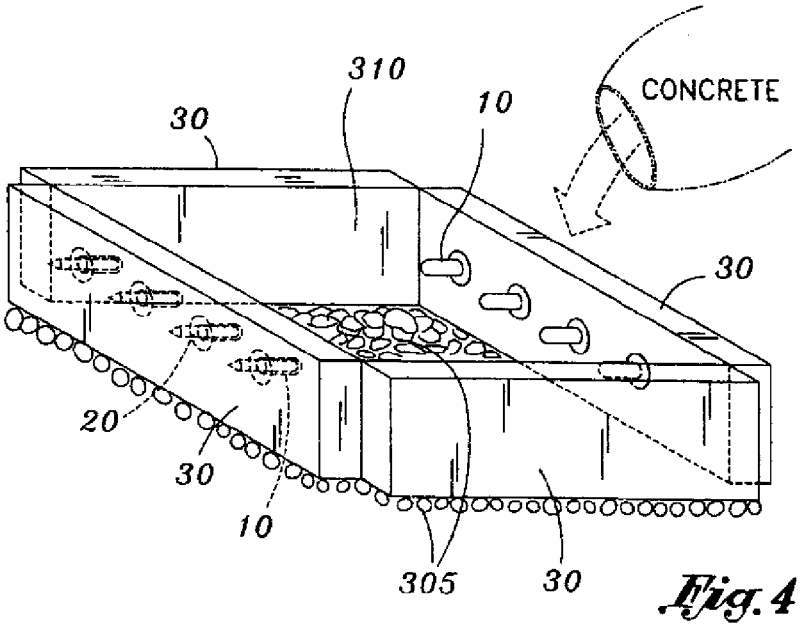
FIG. 4 is a perspective view of a plurality of forms defining an enclosed area.

With reference now to FIG. 4, four forms 30 are arranged in a quadrangular configuration, forming a first enclosed area 310. While FIG. 4 illustrates a quadrangular configuration, it is to be understood that the first enclosed area 310 can be any shape capable of being formed using conventional techniques well known in the art. As will be appreciated, a desired surface is excavated and a base course 305 comprised of larger-sized aggregate is formed prior to forming the first enclosed area 310.

As set forth above, preferably each of the forms 30, or at least one of the forms 30, have the stud 20 centrally attached thereto by any of the described embodiments, including a unitary stud 20 which includes a tapered section for insertion into the forms 30, a separate screw/hollow stud combination or the nail/hollow stud combination. The number of the studs 20 attached varies according to the needs of each application, and the proper distribution and spacing will be readily determined by a person having ordinary skill in the art. Further, each of the studs 20 have attached thereto the cover 10 as set forth above. As the height of the forms 30 defines the height of the ultimate concrete structure formed thereby since concrete is poured to be flush with the upper surface of the same, preferably the studs 20 are inserted in the longitudinal center of forms 30 to maximize the compressive strength of the concrete. Typically, the forms 30 are dimensional lumber such as a two-by-four, which is nominally two inches by four inches (2" by 4"), but can be as small as one and a half inches by three and a half inches (1½" by 3½").

Still referring to FIG. 4, and now, additionally to FIG. 1*a*, upon forming an enclosed area 310 on top of a base course 305 in the desired configuration, a slab of concrete 300 is poured therein. Although any well known paving material may be used, concrete comprised of Portland cement and a mineral aggregate such as gravel or sand is preferred. As is understood, concrete is liquid in form before curing, and after pouring, the cement begins to hydrate and glue the aggregate and the cement together, forming a rock-like material. Thus, the outer surface of the speed cover 10 forms a bond with the surrounding concrete slab 300, and remains embedded therein. Since the proximal end 16 of speed cover 10 abuts the form 30, and therefore the edge of the concrete slab 300, the interior compartment 18 does not fill with concrete and remains exposed to the exterior of concrete slab 300. The occupation of the interior compartment 18 by the stud 20 further reduces the tendency of concrete to flow inside speed covers 10.

Figure 5:
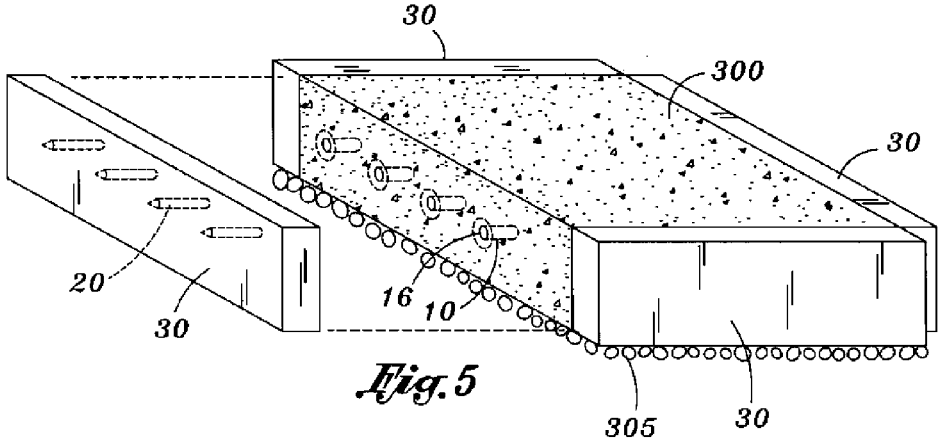
FIG. 5 is a perspective view of a first slab of concrete surrounded by a plurality of forms, with one form being removed from the concrete.

Now referring to FIG. 5, shown is the first cured slab of concrete 300, with the form 30 being removed. Along with the form 30, also removed are the studs 20 previously embedded within the speed cover 10. As a result of the sliding relation, the studs 20 are easily and quickly removed from the speed covers 10. As illustrated, the speed covers 10 remains in the cured slab of concrete 300, and the open proximal end 16 of the speed covers 10 forms an edge of the cured slab of concrete 300. Further, a cavity within the cured slab of concrete 300 is effectively defined by the interior compartment 18 of the speed covers 10.

Figure 6:
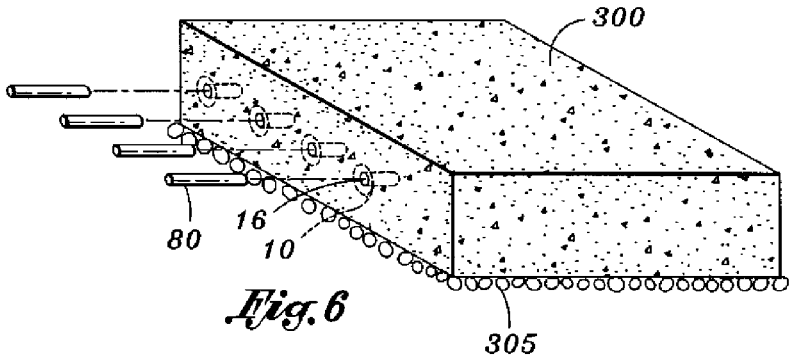
FIG. 6 is a perspective view of a first slab of concrete with speed covers within, and the placement of dowels.

Referring to FIG. 6, metallic dowels 80 are inserted into the interior compartment 18 of each of the speed covers 10 embedded within the first cured concrete slab 300. Essentially, the speed covers 10 eliminate the error-prone drilling step in previously known methods of forming cavities for inserting dowels to brace "cold joints" between two sequentially poured slabs of concrete. The metallic dowels are preferably quarter inch (¼") in diameter, and constructed of stainless steel. As a person of ordinary skill in the art will recognize, a smaller diameter stainless steel dowel possesses the same sheer strength characteristics as that of a larger diameter mild steel dowel. For example, a quarter-inch (¼") stainless steel dowel has the same sheer strength as that of a half-inch (½") mild steel dowel. Preferably, the metallic dowels 80 extend fully into speed cover 10, and extend a substantial distance out of the same.

Figure 7:
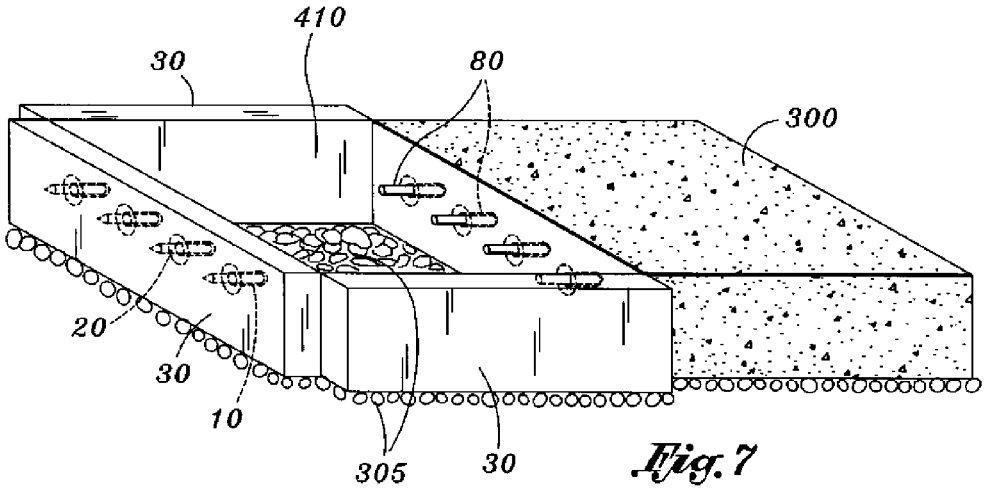
FIG. 7 is a perspective view of a first slab of concrete with speed covers within and dowels extending into a second enclosed area defined by an edge of the first slab of concrete and a plurality of forms.

With reference now to FIG. 7, a second enclosed area 410 is constructed with the forms 30, with at least one edge defined by the first concrete slab 300 with the metallic dowels 80 extending therefrom. If another slab of concrete in addition to the one formed by the second enclosed area 410 is desired, the forms 30 will again include one or more studs 20 inserted thereon, and one or more covers 10 placed on the studs 20. A second slab of concrete 400 is poured into the second enclosed area 410, and is allowed to cure. In this fashion, a cold joint between the first slab of concrete 300 and the second slab of concrete 400 is formed.

Figure 8:
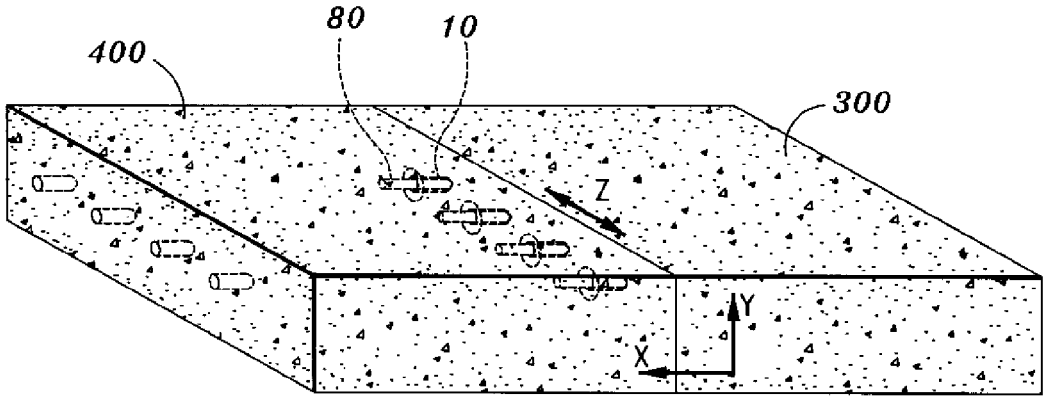
FIG. 8 is a perspective view of a first and second slab of concrete supported by a plurality of speed covers and dowels within respective concrete slabs.
Figure 9:
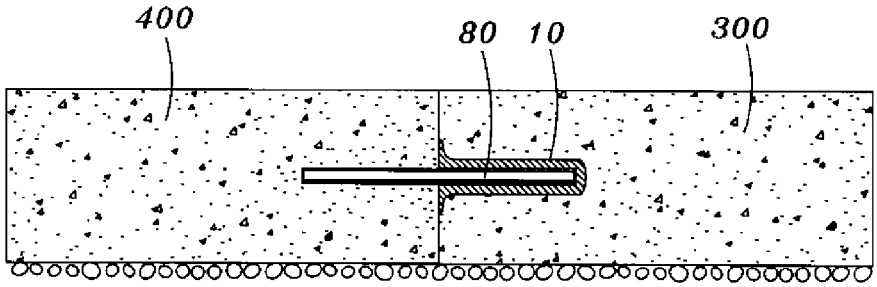
FIG. 9 is a side view of a first and second slab of concrete supported by a speed cover and a dowel within respective concrete slabs.

As illustrated in FIGS. 8 and 9, the exposed metallic dowels 80 is embedded within the second slab of concrete 400, and extends into the first slab of concrete 300 via the speed cover 10. With steel having substantially the same coefficient of thermal expansion as concrete, during temperature shifts the first slab of concrete 300 is permitted to expand and contract about the second slab of concrete 400 and vice versa along axis X of the metallic dowel 80. Further, the aforementioned molded plastic construction of the speed cover 10 enable the first and the second concrete stabs 300 and 400, respectively, to expand and contract a limited amount along the Z and Y axes. As a person of ordinary skill in the art will recognize, however, metallic dowel 80 is configured to significantly reduce such transformations. Thus, while the flexible characteristics of the speed cover 10 enable miniscule adjustments, large expansions and contractions are diminished by the placement of the metallic dowel 80.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. A concrete dowel placement device for use with a form, the form being used to define an enclosed area within which concrete is poured to form a first concrete slab, the form defined by an interior side facing the enclosed area and an opposed exterior side, the form being removed from the enclosed area once the first concrete slab has cured, the concrete dowel placement device comprising:

a stud having a stud proximal end portion and a stud distal end portion, the stud proximal end portion being insertable into the form from the interior side thereof to mount the stud to the form, the stud distal end portion extending from the form into the enclosed area during formation of the first concrete slab, the stud being sized and configured to remain mounted to the form during removal of the form from the enclosed area after the first concrete slab has cured; and a stud cover configured to be temporarily disposable in abutting contact with the form during formation of the first concrete slab, the stud cover having a cover body including a cover proximal end portion and a cover distal end portion, the cover proximal end portion defining an opening, the cover body defining an inner recess extending into the cover body from the cover proximal end portion toward the cover distal end portion, the inner recess being sized and configured to slidably receive the stud to maintain the stud cover in abutting contact with the form during formation of the first concrete slab, the inner recess further being sized and configured to allow the stud to be slidably removed therefrom to remove the stud cover from abutting contact with the form when the form is removed from the enclosed area after the first concrete slab has cured.

2. The concrete dowel placement device recited in claim 1, wherein the cover proximal end portion defines a flange, the flange being disposable in a stabilizing flush and abutting contact with the form.

3. The concrete dowel placement device recited in claim 1, wherein the stud is engageable with the form without extending through the form.

4. The concrete dowel placement device recited in claim 1, wherein the stud is a nail.

5. The concrete dowel placement device recited in claim 1, wherein the stud is a screw.

6. The concrete dowel placement device recited in claim 1, wherein the cover distal end portion defines a substantially cylindrical shape.

7. The concrete dowel placement device recited in claim 1, further comprising a stud sleeve circumferentially disposable about the stud distal end portion, the inner recess of the cover body being sized and configured to receive the sleeve stud and the stud distal end portion when the sleeve stud is disposed about the stud distal end portion.

8. The concrete dowel placement device recited in claim 1, wherein the stud proximal end portion defines a tapered shape defining a point for ease in driving the stud proximal end portion into the form.

9. The concrete dowel placement device recited in claim 1, wherein the stud proximal end portion is threaded and defines a tapered shape defining a point for screwing the stud into the form.

10. The concrete dowel placement device recited in claim 1, wherein the stud cover is formed of plastic.

11. The concrete dowel placement device recited in claim 1, wherein the stud is ¼ inch in diameter.

12. A concrete dowel alignment system for use with a form while constructing a first concrete slab and an adjacent second concrete slab, the form defined by a first side facing the first concrete slab and an opposed second side, the concrete dowel alignment system comprising:

a stud having a stud proximal end portion and a stud distal end portion, the stud proximal end portion being disposable within the form from the first side, the stud distal end portion extending from the form when the stud proximal end portion is disposed within the form;

a stud cover temporarily disposable in abutting contact with the form, the stud cover having a cover body including a cover proximal end portion and a cover distal end portion, the cover proximal end portion defining an opening, the cover body defining an inner recess extending into the cover body from the cover proximal end portion toward the cover distal end portion, the inner recess being sized and configured to temporarily slidably receive the stud to maintain the stud cover in abutting contact with the form during formation and curing of the first concrete slab, the inner recess being sized and configured to enable removal of the stud therefrom after the first concrete slab has cured; and a dowel having a first end portion and a second end portion, the first end portion being sized and configured to be slidably received within the inner recess after the stud proximal end portion has been removed from the inner recess, the second end portion to be encapsulated within the second concrete slab.

13. The concrete dowel placement device recited in claim 12, wherein the cover proximal end portion defines a flange, the flange being disposable in a stabilizing flush and abutting contact with the form.

14. The concrete dowel placement device recited in claim 12, wherein the stud is engageable with the form independent of extending through the form.

15. The concrete dowel placement device recited in claim 12, wherein the cover distal end portion defines a substantially cylindrical shape.

16. The concrete dowel placement device recited in claim 12, further comprising a stud sleeve circumferentially disposable about the stud distal end portion, the inner recess of the cover body being sized and configured to receive the sleeve stud and the stud distal end portion when the sleeve stud is disposed about the stud distal end portion.

17. The concrete dowel placement device recited in claim 12, wherein the stud proximal end portion defines a tapered shape defining a point for ease in driving the stud proximal end portion into the form.

18. The concrete dowel placement device recited in claim 12, wherein the stud proximal end portion is threaded and defines a tapered shape defining a point for screwing the stud into the form.

19. The concrete dowel placement device recited in claim 12, wherein the stud cover is formed of plastic.

20. The concrete dowel placement device recited in claim 12, wherein the stud is ¼ inch in diameter.

21. A concrete dowel placement device for use with a form, the form being used to define an enclosed area within which concrete is poured to form a first concrete slab, the form being removed from the enclosed area once the first concrete slab has cured, the concrete dowel placement device comprising:

a stud having a stud proximal end portion and a stud distal end portion, the stud proximal end portion being insertable into the form to mount the stud to the form, the stud distal end portion extending from the form into the enclosed area during formation of the first concrete slab, the stud being sized and configured to remain mounted to the form during removal of the form from the enclosed area after the first concrete slab has cured; and a stud cover configured to be temporarily disposable in abutting contact with the form during formation of the first concrete slab, the stud cover having a cover body including a cover proximal end portion and a cover distal end portion, the cover proximal end portion defining an opening and a flange disposable in a stabilizing flush and abutting contact with the form, the cover body defining an inner recess extending into the cover body from the cover proximal end portion toward the cover distal end portion, the inner recess being sized and configured to slidably receive the stud to maintain the stud cover in abutting contact with the form during formation of the first concrete slab, the inner recess further being sized and configured to allow the stud to be slidably removed therefrom to remove the stud cover from abutting contact with the form when the form is removed from the enclosed area after the first concrete slab has cured.

22. The concrete dowel placement device recited in claim 21, wherein the stud is engageable with the form without extending through the form.

23. The concrete dowel placement device recited in claim 21, wherein the cover distal end portion defines a substantially cylindrical shape.

24. The concrete dowel placement device recited in claim 21, further comprising a stud sleeve circumferentially disposable about the stud distal end portion, the inner recess of the cover body being sized and configured to receive the sleeve stud and the stud distal end portion when the sleeve stud is disposed about the stud distal end portion.

25. The concrete dowel placement device recited in claim 21, wherein the stud proximal end portion defines a tapered shape defining a point for ease in driving the stud proximal end portion into the form.

26. The concrete dowel placement device recited in claim 21, wherein the stud proximal end portion is threaded and defines a tapered shape defining a point for screwing the stud into the form.

27. A concrete dowel alignment system for use with a form while constructing a first concrete slab and an adjacent second concrete slab, the concrete dowel alignment system comprising:

a stud having a stud proximal end portion and a stud distal end portion, the stud proximal end portion being disposable within the form, the stud distal end portion extending from the form when the stud proximal end portion is disposed within the form;

a stud cover temporarily disposable in abutting contact with the form, the stud cover having a cover body including a cover proximal end portion and a cover distal end portion, the cover proximal end portion defining an opening and a flange disposable in a stabilizing flush and abutting contact with the form, the cover body defining an inner recess extending into the cover body from the cover proximal end portion toward the cover distal end portion, the inner recess being sized and configured to temporarily slidably receive the stud to maintain the stud cover in abutting contact with the form during formation and curing of the first concrete slab, the inner recess being sized and configured to enable removal of the stud therefrom after the first concrete slab has cured; and a dowel having a first end portion and a second end portion, the first end portion being sized and configured to be slidably received within the inner recess after the stud proximal end portion has been removed from the inner recess, the second end portion to be encapsulated within the second concrete slab.

28. The concrete dowel placement device recited in claim 27, wherein the stud is engageable with the form without extending through the form.

29. The concrete dowel placement device recited in claim 27, wherein the cover distal end portion defines a substantially cylindrical shape.

30. The concrete dowel placement device recited in claim 27, further comprising a stud sleeve circumferentially disposable about the stud distal end portion, the inner recess of the cover body being sized and configured to receive the sleeve stud and the stud distal end portion when the sleeve stud is disposed about the stud distal end portion.

31. The concrete dowel placement device recited in claim 27, wherein the stud proximal end portion defines a tapered shape defining a point for ease in driving the stud proximal end portion into the form.

32. The concrete dowel placement device recited in claim 27, wherein the stud proximal end portion is threaded and defines a tapered shape defining a point for screwing the stud into the form.

* * * * *